United States Patent [19]

Blackburn

[11] Patent Number: 4,972,305

[45] Date of Patent: Nov. 20, 1990

[54] LIGHT IMAGE GENERATING SYSTEM

[76] Inventor: R. Geoffrey Blackburn, 1018 E. 4555 South, Salt Lake City, Utah 84117

[21] Appl. No.: 399,025

[22] Filed: Aug. 28, 1989

Related U.S. Application Data

[63] Continuation-in-part of Ser. No. 194,223, May 16, 1988, abandoned.

[51] Int. Cl.[5] ..... F21V 33/00; G09F 13/00

[52] U.S. Cl. ..... 362/234; 362/35; 362/243; 362/806; 40/432

[58] Field of Search ..... 362/295, 230, 231, 232, 362/234, 243, 244, 247, 245, 251, 35, 806, 811; 40/427, 429, 430, 431, 432, 436, 442, 444, 443; 353/28, 65–67; 272/10, 8 P

[56] References Cited

U.S. PATENT DOCUMENTS

| | | | |
|---|---|---|---|
| 2,173,939 | 9/1937 | Hall | 40/432 |
| 2,211,353 | 8/1940 | Solkover | 40/429 |
| 2,937,564 | 5/1960 | Halford, Jr. | 40/432 |
| 3,104,815 | 9/1963 | Schultz | 362/35 |
| 3,538,323 | 11/1970 | Ziegler | 362/806 |
| 3,707,115 | 12/1972 | Rush | 40/442 |
| 3,738,035 | 6/1973 | Bricker | 40/431 |
| 3,793,755 | 2/1974 | Gersch et al. | 40/581 |
| 4,358,754 | 11/1982 | Young et al. | 362/811 |

*Primary Examiner*—Ira S. Lazarus
*Assistant Examiner*—D. M. Cox
*Attorney, Agent, or Firm*—Marcus G. Theodore

[57] ABSTRACT

A light image generating system comprising a light conducting sculpture constructed of a material capable of diffusing, reflecting, refracting, transmitting, and/or mixing light passing therethrough from a light generating display pedestal controlled by a light frequency and amplification control module which also regulates sounds and music to accompany the projected sculpture light images.

24 Claims, 4 Drawing Sheets

LIGHT IMAGE GENERATING SYSTEM

RELATED APPLICATIONS

This application is a continuation-in-part application of the application entitled Light "Image Generating System", Ser. No. 194,223, filed May 16, 1988, now abandoned.

BACKGROUND OF THE INVENTION

1. Field

This invention pertains to light image generating systems. More particularly, it relates to a light-image generating system incorporating a light-transmitting interactive sculpture associated with a light emitting display pedestal to provide images of the sculpture having varying frequencies, intensities, and colors of the light.

2. Background of the Invention

A number of movie and light shows utilizing a screen projection system are known. All project light images onto a two dimensional screen for viewing. For example, a movie projector produces film images projected onto the screen by an intense light. In planetarium projectors, the lights are electronically controlled and projected directly onto the screen. Although these screen projection systems utilize light and sound, they do not incorporate a three dimensional sculpture diffusing and modifying the light patterns as part of the visual experience.

Various light display systems for sculpture pieces are also known. Typically, modern sculpture display galleries incorporate a fixed pedestal onto which a separate opaque or transparent sculpture piece may be placed and illuminated by at least one direct or indirect light source. Occasionally, the conventional pedestal may rotate to display all angles of the sculpture piece. However, the conventional pedestal is not generally designed to generate secondary images by causing the sculpture piece itself to glow, while projecting secondary light onto and through the integrated sculpture piece to alter the frequency, color reflection, and refraction characteristics of the images. A more elaborate display light sculpture is described in Gersch et al., U.S. Pat. No. 3,793,755.

The color organ is an example of a lighting system which alters the frequency and colors of a bank of lights in response to differing musical frequencies. It does not utilize a rotating sculpture piece to alter projected images. This type of lighting system may be incorporated to to diffuse and refract the light through a cover plate defining a symbol to be advertised in response to sound in a manner similar to the sound actuated advertising display described in Young et al., U.S. Pat. No. 4,358,754.

Other transparent sculptures may incorporate an internal light source, transmitting light along internal light carrying channels, such as fiber optical media, to illuminate selected areas of the sculpture. In more conventional variations, the light sculptures are constructed of transparent media to transmit light from the internal light source to function more as a lamp, such as the embodiment described in R. M. Ziegler, U.S. Pat. No. 3,538,323. These lamp type of sculptures are generally not designed to be externally illuminated to cause a change in the color and type of images projected by the sculptures. Bricker, U.S. Pat. No. 3,738,035 is an example of a pulsing light pedestal display onto which light conducting members are mounted to receive a pulse of light from a light source. The entire assembly is mounted within an opaque plastic housing. The Bricker device may incorporate a turntable in which is mounted the light source to direct light through a slot to intermittently direct light through the light conducting members. Bricker does not incorporate screens and secondary light sources to create shadows, and secondary images.

Other light systems are used with displays and dioramas to produce still and animated stage and screen scenes, such as those described in Dietlein, U.S. Pat. No. 2,096,884, Rush, U.S. Pat. No. 3,707,115, Solkover, U.S. Pat. No. 2,211,353, Hall, U.S. Pat. No. 2,173,939, Wilfred, U.S. Pat. No. 1,7349,011, Wittstein, U.S. Pat. No. 1,905,544, Sauvage, U.S. Pat. No. 2,576,147, and Reiback, U.S. Pat. No. 4,261,657.

Sited for general interest are: Fleemin, U.S. Pat. No. 4,490,931, a display device and method to display preserved biological materials, Roegner et al., U.S. Pat. No. 4,250,537, a discotheque simulating home entertainment system, and Schultz, U.S. Pat. No. 3,104,815 describing an illuminated sprinkler.

None of these inventions provides a light-image and manipulating system having a multi-dimensional, mixed media sculpture, light, and sound system employing multiple screens, such as that described below.

SUMMARY OF THE INVENTION

Applicant's invention comprises a light transmitting sculpture associated with a light generating display pedestal controlled by a light frequency and amplification control module. The sculpture is constructed of a transparent or translucent material, such as glass, plexiglass, plastic, nylon, etc., capable of diffusing, reflecting, refracting, transmitting, and/or mixing light passing therethrough.

The display pedestal contains a light source having a plurality of lights capable of projecting multi-colored light onto a central display area containing the sculpture. These lights may consist of conventional iridescent bulbs and floodlights, or more sophisticated laser or fiber optically generated lights. Preferably, the light bulbs have differing colors and transmission qualities, resulting from frosted bulbs which provide a more diffused light intermixed with clear bulbs which provide more intense colors. In other embodiments, laser lights, and colored filters and lenses may also be incorporated.

The base of the sculpture is mounted onto the central display area to receive light and internally reflect, refract, and transmit the same throughout the sculpture to project an illuminated image. The base of the central display area may be structured to allow the insertion of interchangeable, removable opaque, transparent, or translucent display template inserts which allow different light transmission frequencies and patterns to pass through the display area. These display template inserts may be colored or patterned to suit the preference of a user. Alternatively, the display template inserts may function as a filter to color and alter the light transmission frequencies of the light passing through the display area.

The exterior of the sculpture may be simultaneously illuminated by an exteriorly positioned, but system controlled, secondary light source to interact with the internally transmitted light to provide a combined ethereal image. Particularly striking shadows, and colored secondary images may be achieved by moving the secondary light sources. One particularly striking affect results when a colored light is transmitted through the display area of the base, and a secondary white light is projected onto the sculpture to cast shadows onto the display area. The areas of the display area contacted by the direct light washes out the color of the display area. Where the shadows appear, the colored lights from the display area are not overcome by the secondary light and provide what appears to be colored shadows of the sculpture.

The display pedestal display area may be fixed, or capable of manual or mechanical movement or rotation. In a preferred embodiment, the pedestal is structured to be continually rotated by a mechanical drive motor to turn the display area 360° to completely rotate the sculpture. Alternatively, the drive motor is deleted, and the sculpture manually turned by a user to provide the desired effect. In another preferred embodiment, the pedestal display area is capable of vertical or lateral movement, although other pedestal movements could also be incorporated, such as a rocking or swinging pendulum motion.

In addition, the display pedestal may include sound generating capability via a built-in sound system, or interfacing with an exterior sound system. Conventional cassette tape, CD, or floppy disk systems are preferred to enable interchangeable sound recordings to be incorporated. The sounds, and music are generally selected to match the image movements and provide the desired mood atmosphere to the user. Relaxation tapes and sounds are particularly preferred.

In one preferred embodiment, the display pedestal and sculpture are resistant to liquids, and structured as a circulating fountain or submerged sculpture to interact with water or other liquids, such as transparent oils, and flowing sand mixtures. The flowing transparent liquids have different reflective and refractive properties which again alter the light images generated by the sculpture.

System controls are included to selectively activate and vary the intensity of each light in the light source. The controls, which may include manual or automatically adjusted switches, vary each respective light in response to the sounds, or music generated by the sound-system in a manner similar to a color organ. In one preferred embodiment, pre-recorded light and motion patterns, and sound shows may be automatically incorporated into the system controls. The images, sounds, and rotation of the sculpture are choreographed to project a pre-packaged visual and musical experience. The system controls may include interchangeable programming capability, such as interchangeable cassettes, CD's, or floppy disks, which enable differing pre-packaged programs to be inserted to activate and control the light, sound, and motion generating and recording system. In the manual control system, the user may directly adjust and vary the sounds and light patterns and images to create a desired mood.

The sculpture is constructed of a variety of transparent and translucent materials. They may by assembled in various combinations of differing laminates and optical fiber materials to provide the desired aesthetic designs. Preferably, opaque materials are interposed and interjected within the translucent and transparent materials of the sculpture design to provide differing shapes and shadows in the design.

The display pedestal has a light transmitting display area at the top mounted on the sidewalls encasing the light system. This display area is preferably constructed of a transparent or translucent heat shielding reflective material to prevent damage to the sculpture and onlookers. The exterior of the surrounding base sidewalls may also be decorated, or colored to suit the preference of a user. For this purpose, reflective materials, lights, and other devices may be affixed to the exterior of the surrounding base in a desired pattern.

The system control module includes a variety of conventional switching and amplification and dimming electrical circuits associated with a power source to selectively activate the lights, and provide the desired illumination and motion of the sculpture. Manual switches activated by a user may be incorporated, or the system may incorporate pre-programmed switching as described above.

A secondary source of illumination may be incorporated for use with the system. For example, overhead, or indirect lighting of the sculpture may be included to blend and mix colors with those emitted by the sculpture, as well as project shadows of the sculpture onto a viewing screen. When secondary illumination is incorporated, a number of reflective, translucent, transparent, or opaque screens and curtains may also be included to capture and alter the images of the sculpture. These screens provide secondary, and tertiary, etc., images and shadows which enhance the effects of the illuminated sculpture. When reflective screens are incorporated, multiple reflective sculpture images from many angles may be produced to provide an ethereal floating effect. These screens may also be moved or angled to provide an interplay of secondary images.

In one preferred embodiment, the screens are also structured to receive interchangeable removable mirrors and template inserts. A user can alter the number and type of reflecting images by inserting inserts with varying reflective properties. These reflective inserts are made of a transparent, translucent, reflective, or filter material, which is usually color coordinated with the display lights to provide the desired effect. Preferably, these screens are adapted to provide desired reflective images, when used with ordinary room light which acts as a secondary source. Sculptures constructed of transparent, semi-opaque and opaque materials are particularly suitable for use in ordinary room light. Reflective screens are then positioned to provide two dimensional images of the sculpture, which appear to be three dimensional. Although the screens are normally planer, striking images can be generated by curved, or irregular surfaces. Other lens magnification mirrored screens may also be used. When these screens are illuminated by an independent colored light source, the screen provides a colored backdrop for the sculpture.

These screens may also be constructed of different transparent, semi-opaque and/or opaque materials to provide different images of the sculpture when viewed from the screens' front or rear. Thus the number of reflective images generated varies dependent upon the vantage point of the viewer.

A user may utilize the light generating system components separately, or in varying permutations and combinations. The sculptures are usually interchangeably attached to the display pedestal to enable the user to incorporate different shapes generating varying shadows, and light images. Preferably the system controls are activated by interchangeable cassettes, or other recording media. This enables the different pre-packaged music, sounds, motion, and light choreographs to be used in the system where the pre-recorded media alone drives the light frequencies, motion, and intensities. The system controls selectively activate the individual lights and motion generating mechanism automatically providing the multi-media experience. The sculpture design, rotation, light illumination, and sound effects may all be coordinated to alter, or compliment the mood of the user. Where manual system controls are activated, the user can "play" the system a la musical instrument, generating his own "real time" designs and light show experience.

The system may be modularly assembled, and upgraded with more complex modules and screens to provide a wider variety of visual and sound outputs.

DESCRIPTION OF THE ILLUSTRATED EMBODIMENTS

Figure 1:
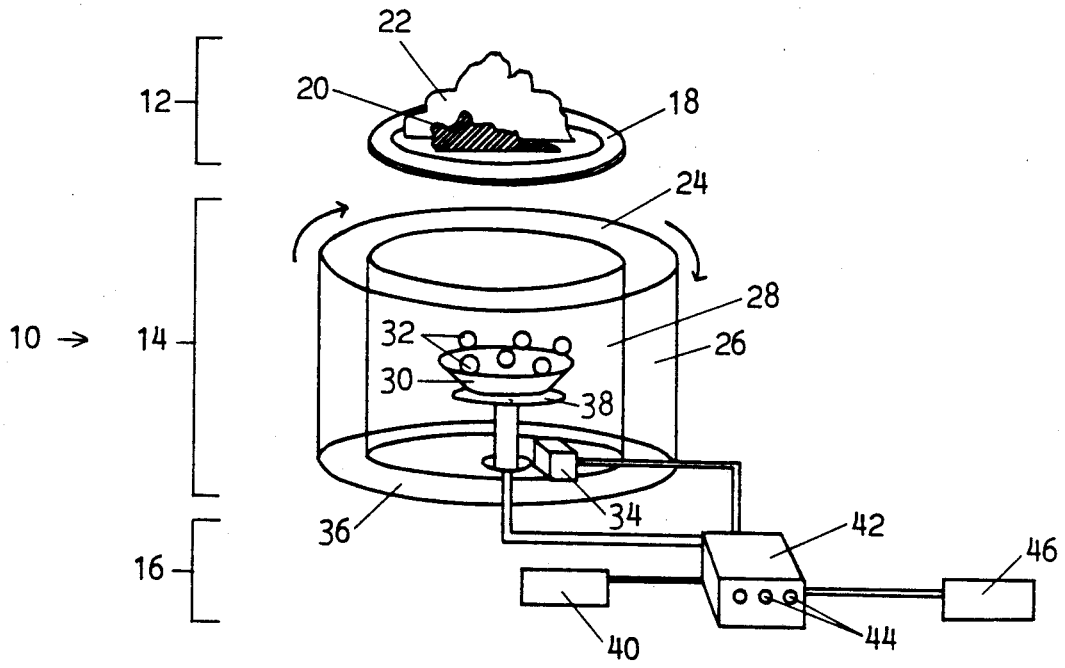
FIG. 1 is a perspective view of one preferred embodiment of the invention.

As shown in FIG. 1, applicant's light generating system 10 comprises three components: a sculpture component 12, a display pedestal component 14, and a control module component 16. The sculpture component 12 has a light transmitting base 18 upon which opaque 20 and translucent/transparent 22 pieces are assembled and attached in the desired shape. The opaque and translucent pieces 20, 22 are mounted in association with the transmitting base 18 to receive light and diffuse, reflect, and refract the same through, from, and/or onto, the surfaces of the pieces 20, 22.

The pedestal component 14 consists of a display area 24, attached to tubular side walls 26 surrounding a primary light source 30 mounted therein. The display area 24 is constructed of a light transmitting, heat shielding material. The primary light source 30 comprises a plurality of colored lights 32, each associated with a dimmer 44. The interior of the tubular sidewalls 26 may have highly reflective mirrored inner walls or an inner liner 28 to amplify the light transmission from the light source 30, and shield the tubular sidewalls 26 from heat. The sculpture component 12 is placed on the display area 24 to receive light from the primary light source 30. The tubular walls 26 of the pedestal component 14 may be attached to a rotating base 36, thus enabling manual or motor driven rotation of the pedestal component up to 360°; thereby rotating the sculpture 20 as well. In addition, the primary light source 30 may include rotation means 36 to also rotate in conjunction with, or in a different relationship to, the rotation of the pedestal component 14 to provide the desired effect.

The control module component 16 consists of a power source 40 (such as an electrical outlet or battery), a control module or box 42 with a plurality of manual switches 44 and a built-in or external sound system 46. The control module 42 selectively activates the drive motor 34, the primary light source 30, and the light rotation means 38 to provide the desired effects. The control module 42 may control and/or include a sound system 46 to provide sounds or music in conjunction with the varying light images produced. The manual switches 44 are operably associated with an electrical power source 40, the light source 30, the sound system 46, and rotation means 34, 38 to selectively activate the same by the user to provide the desired multi-media sound, and visual effects. Preferably, natural sounds, such as running water, wind, and animal sounds, are intermixed with musical sounds for a surrealistic calming effect, when associated with a cloud shaped sculpture 12 generating floating images. Conversely, more active sounds and music can be employed to match a more active sculpture form to suit the mood of a user.

Figure 2:
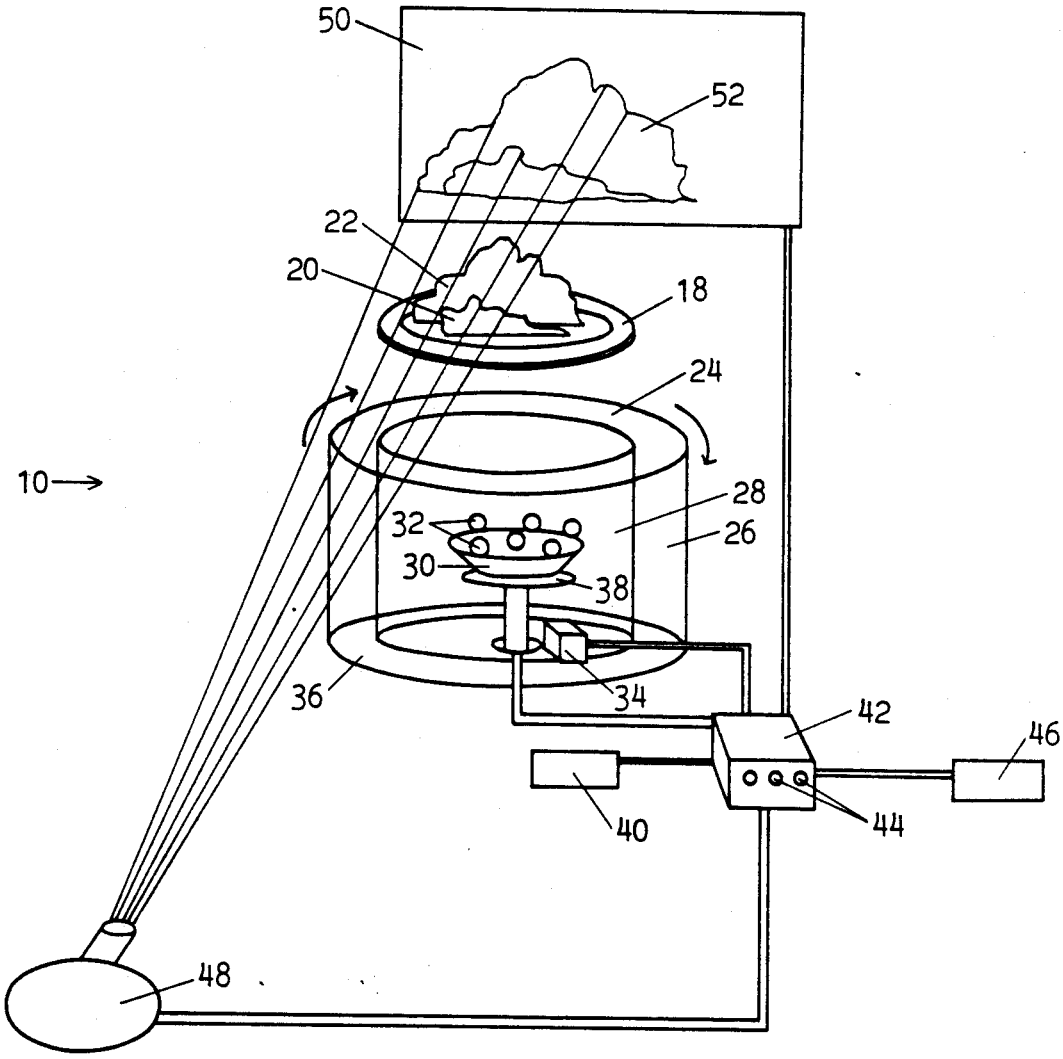
FIG. 2 is another perspective view of another preferred embodiment of the invention.

FIG. 2 illustrates another preferred embodiment of applicant's invention utilizing a secondary external light source 48 and an opaque screen 50 to produce additional two dimensional images 52. The secondary light source 48 projects varying colors and hues of light onto and through the the sculpture 12 to interact with the light transmitted by the primary light source 30 and sculpture 12 to project varying shadow images onto the opaque screen 50 as the sculpture 12 is rotated.

Figure 3:
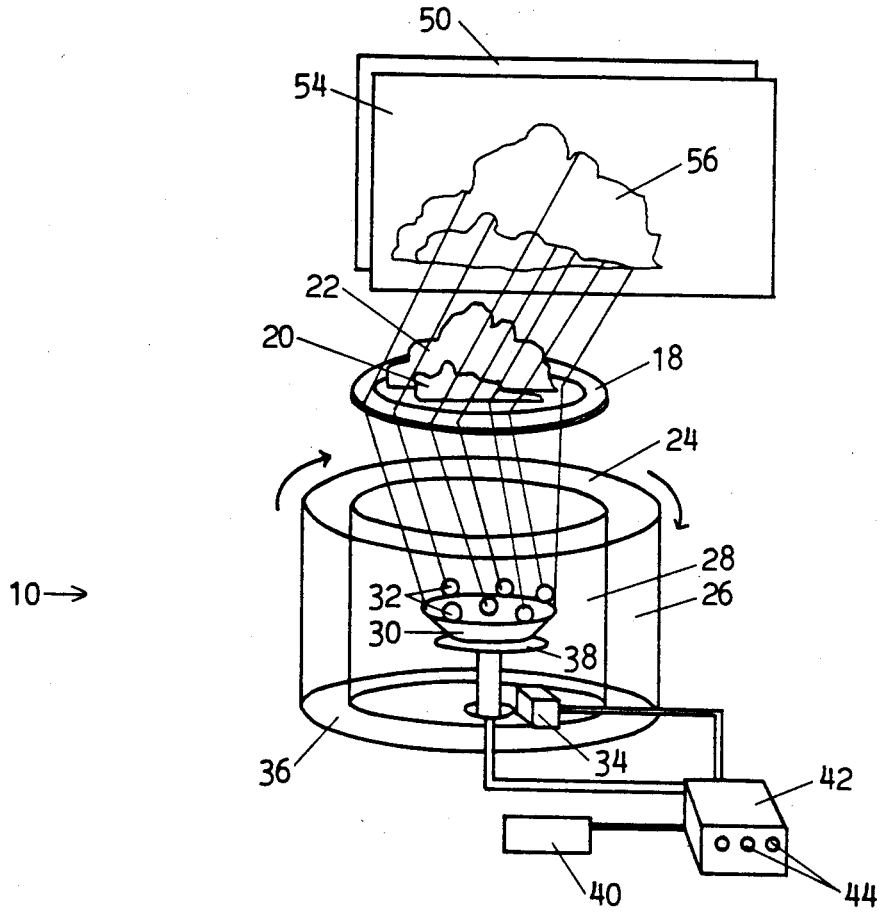
FIG. 3 is a perspective view of another preferred embodiment of the invention.

In other embodiments shown in FIG. 3, the screen 54 may be transparent/transluscent and when placed at various angles to the sculpture 12 will reflect a ghostlike floating image 56 of the sculpture 12. A plurality opaque screens 50 may be incorporated in sequence or in parallel with a reflective screen 54 to provide multiple full and partial images. For added effect, the screens 50, 54 may be stationary or mobile. Mobile screens 50, 54 are controlled by the control module 16. A rippling or gossamer effect is developed when the screens 50, 54 are constructed or a cloth or flexible fabric.

The use in combination of the additional reflective and opaque screens 50, 54 provides a variety of third dimensional floating, shadow, and reflective images of the sculpture. For maximum convenience, and more controlled effects on the screen, pre-programmed choreographed light shows are generally utilized with this screen embodiment which generally requires a control module 16 to automatically coordinate the sound, primary and secondary light sources, sculpture rotation and positioning of the screens.

Figure 4:
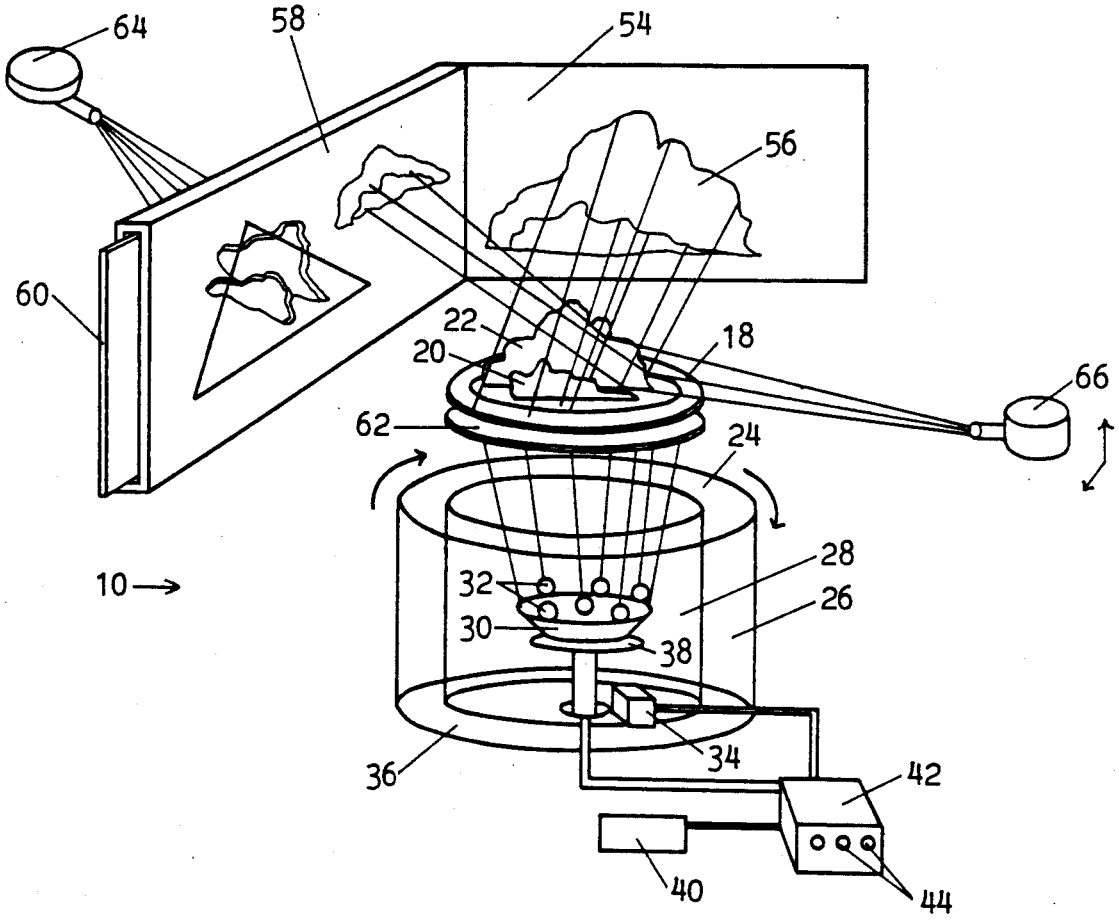
FIG. 4 is a perspective view of another preferred embodiment of the invention.
Figure 5:
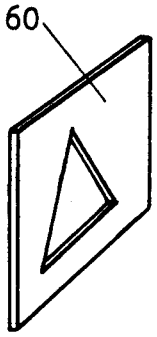
FIG. 5 is a perspective view of a removable screen insert.

FIG. 4 illustrates the use of a screen 58 capable of using removable, interchangeable screen inserts 60. The screen 58 is transparent, and has its reflective characteristics altered by the insertion of the desired screen insert 60. The screen insert 60 may have a template pattern cut therein as shown in FIG. 5. When a secondary source of light 64 is transmitted through the rear of the screen 58, the image of the sculpture 56 is altered by the light passing through the template pattern cut. A movable tertiary source of light 66 projects onto the sculpture pieces 20, 22 to create different moving shadows and colored images.

FIG. 4 also illustrates the use of a removable interchangeable display template 62 designed to project desired patterns of light onto the sculpture pieces 20, 22. The display template 62 may also be constructed of an opaque or translucent material which acts as a light filter to alter the light frequency transmitted by the light source 32 to provide the desired frequency, and color of light onto the sculpture.

Figure 6:
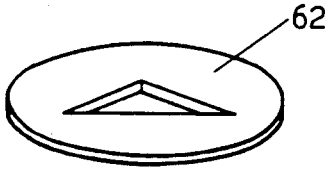
FIG. 6 is a perspective view of a display template insert.

FIG. 6 illustrates a typical display template 62 structured to allow the desired shape or form of light to pass through the display area 18 onto the sculpture pieces 20, 22.

Although this specification has made reference to the specific embodiments, it is not intended to restrict the scope of the appended claims. The claims themselves recite those features deemed essential to the invention.

I claim:

1. A light image generating system comprising:

a. a sculpture component structured in a desired artistic shape and constructed of a material capable of diffusing, reflecting, refracting, transmitting, and mixing light passing therethrough;

b. a display pedestal component having i. a display base, with a transparent display area through which light may pass, surrounding ii. a primary light source capable of projecting light of varying frequencies and intensities through the display area onto which the sculpture is mounted to receive light generated by the light source;

c. control means associated with the light source to selectively activate and vary the frequency and intensity of the light projecting through the display area and sculpture, and d. at least one secondary source of illumination to externally illuminate the sculpture to blend and mix with colors and images emitted by the sculpture, and e. a plurality of screens onto and through which the primary and secondary light sources project images and shadows of the sculpture, wherein at least one screen is constructed of a reflective material to provide a reflected image of the illuminated sculpture.

2. A light image generating system according to claim 1, wherein the primary light source can transmit light from varying positions within the pedestal.

3. A light image generating system according to claim 2, wherein the light sources have a plurality of lights of differing colors and glow transparencies.

4. A light image generating system according to claim 1, wherein the primary light source is stationary, and the sculpture may move in varying positions on the display area.

5. A light image generating system according to claim 1, wherein the exterior of the sculpture is simultaneously illuminated by the secondary light source producing light which interacts with the internally transmitted light passing through the sculpture.

6. A light image generating system according to claim 1, wherein the pedestal display area is movably attached to the pedestal to move the sculpture in a desired loci.

7. A light image generating system according to claim 5, wherein the pedestal display area may move in varying motion patterns.

8. A light image generating system according to claim 1, including a sound system controlled by the system controls to provide sounds to accompany the lighted sculpture images.

9. A light image generating system according to claim 8, wherein the system controls vary the intensity and frequency of the light transmitted by the light sources in response to the intensity and frequency of the sound.

10. A light image generating system according to claim 8, wherein the system controls are adapted to record, playback, and be controlled by interchangeable pre-programmed instructions to vary the sound, light, and movement of the system components.

11. A light image generating system according to claim 1, wherein the display pedestal and sculpture are resistant to fluids; and including transparent liquids, flowing transparent sand mixtures, and the like, surrounding and flowing about the sculpture in a desired flow path to receive and interact with projected light from the sculpture.

12. A light image generating system according to claim 11, wherein the flowing transparent liquids, sand mixtures, and the like have different reflective and refractive properties to alter the light images generated by the sculpture.

13. A light image generating system according to claim 1, wherein the sculpture is constructed of a plurality of transparent and translucent materials assembled in various combinations to provide desired aesthetic designs.

14. A light image generating system according to claim 13, including opaque materials interposed and interjected with the translucent and transparent materials in the sculpture design to provide differing shapes and shadows in the design.

15. A light image generating system according to claim 1, wherein the display area and pedestal are constructed of a heat shielding reflective material to prevent damage to the sculpture and onlookers.

16. A light image generating system according to claim 1, wherein the exterior of the pedestal base is decorated, or colored to suit the preference of a user.

17. A light image generating system according to claim 16, including reflective materials, lights, and other devices affixed to the exterior of the pedestal base.

18. A light image generating system according to claim 1, wherein at least one screen is constructed of a transparent, translucent, or similar light transmitting material to provide a partial image of the illuminated sculpture.

19. A light image generating system according to claim 1, wherein at least one screen is constructed of an opaque material which provides secondary images and shadows of the illuminated sculpture.

20. A light image generating system according to claim 1, including a removable, interchangeable display template with a window in a desired shape inserted between the primary light source, and the display area to alter the shape and color of the light transmitted onto the display area.

21. A light image generating system according to claim 1, including at least one transparent reflective screen with structure to accommodate a removable screen template placed behind the transparent reflective screen and constructed of a material which alters the light and images of the sculpture to meet the needs of a user.

22. A light image generating system according to claim 1, including at least one transparent reflective screen with a template having a window in a desired shape inserted behind the transparent reflective screen and constructed of a material which alters the light and images of the sculpture to meet the needs of a user.

23. A light image generating system according to claim 1, including at least one movable tertiary light source of illumination to externally illuminate the sculpture to blend and mix with colors and images emitted by the sculpture in accordance with the prefernces of a user.

24. A light image generating system according to claim 1, including a secondary light source transmitting the desired frequency and color of light through a transparent reflective screen with a template having a window to alter the light and shadows of the sculpture.

* * * * *